US008368532B2

(12) United States Patent
Foisy et al.

(10) Patent No.: US 8,368,532 B2
(45) Date of Patent: Feb. 5, 2013

(54) SECURITY SYSTEM ANNUNCIATION COMMUNICATION DELAY

(75) Inventors: Stephane Foisy, Udora (CA); Brian Storrie, Innisfil (CA)

(73) Assignee: Tyco Safety Products Canada Ltd., Concord, Ontario (CA)

( * ) Notice: Subject to any disclaimer, the term of this patent is extended or adjusted under 35 U.S.C. 154(b) by 831 days.

(21) Appl. No.: 12/541,414

(22) Filed: Aug. 14, 2009

(65) Prior Publication Data

US 2011/0037593 A1 Feb. 17, 2011

(51) Int. Cl.
*G08B 21/00* (2006.01)

(52) U.S. Cl. ..... 340/540; 340/506; 340/527; 340/529

(58) Field of Classification Search ..... 340/540, 340/545.1, 545.6, 517, 521, 529, 527, 539.1, 340/539.16, 539.19, 505, 506, 507, 286.02, 340/286.06, 286.11, 5.51, 5.53
See application file for complete search history.

(56) References Cited

U.S. PATENT DOCUMENTS

| | | | | |
|---|---|---|---|---|
| 5,892,442 | A * | 4/1999 | Ozery | 340/539.14 |
| 6,204,760 | B1 | 3/2001 | Brunius | |
| 6,847,293 | B2 * | 1/2005 | Menard et al. | 340/539.1 |
| 6,999,562 | B2 | 2/2006 | Winick | |
| 7,054,414 | B2 | 5/2006 | Bergman et al. | |
| 2008/0079561 | A1 | 4/2008 | Trundle et al. | |

* cited by examiner

*Primary Examiner* — Anh V La
(74) *Attorney, Agent, or Firm* — Kacvinsky Daisak pllc

(57) ABSTRACT

A security system including a main control unit, a plurality of sensors and a user interface device. The main control unit communicates with a remote central monitoring station when a sensor detects an alarm event. Once the communication signal from the main control unit is successfully transmitted to the central station, a siren is sounded. Thus, the delay time to trigger the siren is dynamic based on the time it takes for successful transmission of an alarm notification to the central station. This dynamic delay accounts for transmission interruptions between the security system and the central station and allows the location of the main unit and/or the siren from being detected prior to successful alarm transmission to the central station.

19 Claims, 3 Drawing Sheets

SECURITY SYSTEM ANNUNCIATION COMMUNICATION DELAY

BACKGROUND OF THE INVENTION

1. Field of the Invention

Embodiments of the invention relate to the field of electronic security systems. More particularly, the present invention relates to an apparatus and method for providing dynamic alarm notification signals within a security system.

2. Discussion of Related Art

Typical building alarm systems often include a number of devices positioned throughout a building or home to alert occupants of security and fire emergencies. For example, alarm systems may typically include devices such as sensors used to monitor various conditions, such as fire, smoke, toxic gases, high/low temperature (e.g., freezing) or flooding as well as annunciation devices used to alert an occupant of these various conditions. These devices communicate, either wired or wirelessly, with an alarm panel. For example, in response to triggering a door sensor, a signal is transmitted to the alarm panel that in turn may sound or otherwise notify the occurrence of the alarm condition to occupants of the premises and remotely communicate with a monitoring facility, law enforcement or fire department services that may then dispatch capable authorities to intervene at the premises. Communication to the monitoring station is facilitated by a communicator housed within the control panel or configured as a separate device. The communication may be via a Plain Old Telephone System (POTS) dial up jack, internet modem, GSM (Global System for Mobile communications), etc., to provide a communications link between the building in which the alarm system is located and the monitoring facility that is geographically remote from the building. This communication link provides a means for event transmissions to be transmitted between the alarm system and the monitoring facility to provide information about the status of the alarm system (e.g., that it is operational that it has been armed, that it has been disarmed), or provide information about the status of one or more alarms or devices in the building (e.g., that a window or door has been opened or that a smoke or fire detector is experiencing an alarm condition).

As mentioned above, the components of a security system may be hardwired, wireless or a combination thereof. In particular, hardwired systems connect each of the devices, to a control panel which communicates with a POTS interface jack, internet modem, etc., using physical communication medium. Although these systems are reliable, they require increased installation/labor costs. Other systems may take advantage of wireless communication between the devices and a control panel which provides easier installation than hardwired systems. Moreover, certain systems utilize self-contained security control units which contain a control panel, keypad, communicator (RF), and notification device(s) in one package. These units are convenient for use in smaller homes, offices, etc., and are usually located near a door or other entry way. All of these systems are susceptible to the "smash and grab" intruder technique where an intruder smashes through a door and grabs the control unit before an alarm notification signal is sent to the monitoring facility and/or a signal is sent to trigger a notification device such as a siren.

Typically, a delay time is preprogrammed into the system to allow a homeowner with sufficient time to disarm the alarm system. These delay times may be, for example, 60 seconds, but have been getting longer in view of fines assessed by certain municipalities for false alarms providing an intruder with valuable time to defeat the security system. However, the smash and grab technique requires the intruder to locate the control panel during the delay period before an alarm signal is sent to the monitoring facility or notification device within the premises. This is relatively easy for systems that utilise self contained, control units since the control panel usually incorporates a keypad located near an entry door which beeps during the predetermined delay period. For hardwired systems, this requires the intruder to quickly enter and locate the control panel which is usually installed near a telephone interface box, internet modem, etc., in a basement or other utility area. In addition, labor costs associated with installing notification devices such as sirens in remote locations (e.g. attics) have necessitated incorporating these devices into or near the control panels which allows intruders to destroy and/or disarm the notification device once the control panel is located. When the siren or other notification device is incorporated with a control panel that includes a communicator configured to send/receive signals from a monitoring facility, the siren sound also allows the intruder to located and destroy the communicator. Regardless of the type of control unit and/or notification device employed, an intruder has the programmed delay period to locate and smash the unit from the wall before the control unit sends a signal that: (i) initiates a notification device (e.g. siren, lights, etc.) to scare off the intruder; and/or (ii) notifies a monitoring facility of the alarm condition. Thus, there is a need for a security system that provides notification of an alarm event to a monitoring facility without providing an intruder any indication that the communication to the monitoring facility has already occurred.

SUMMARY OF THE INVENTION

Exemplary embodiments of the present invention are directed to an apparatus and method for an electronic security system. In an exemplary embodiment, a system for transmitting alarm notifications for use with an alarm system in a monitored building includes a plurality of devices including sensors and notification devices and a main control unit that communicates with each of the plurality of sensors. The main control unit communicates with a receiver located at a central monitoring to provide alarm event notifications. A machine-readable storage medium encoded with a computer program code is included in the main control unit such that, when the computer program code is executed by a processor, the processor performs a method where event signal data is received by the control unit from at least one of the plurality of sensors and the data is processed by the main control unit. An alarm notification signal representative of the event signal is sent from the main control unit to the receiver at the central monitoring facility by the processor. Alternatively, the signal from the main control unit may be sent to an intermediary site (e.g. clearing house) that translates the signal for the receiver located at the central station. A determination is made whether the alarm notification signal was transmitted successfully to the receiver at the central monitoring facility (or the clearing house). Upon successful transmission of the notification signal from the control unit to the central station a signal is sent from the main control unit to an annunciation device (e.g. siren, light, etc.) to trigger the device.

In another exemplary embodiment, a method of providing a dynamic annunciation signal in an alarm system includes sending event signal data from at least one of a plurality of sensors to a control unit. An alarm notification signal is sent from the control unit to a central monitoring station via a communications link. The method waits for the alarm notification signal from the control unit to be successfully transmitted to a communication point that is configured to receive the alarm notification central monitoring station and once the alarm notification signal is successfully transmitted to this communication point, a signal is sent to an annunciation device (siren, lights, etc.) from the control unit to trigger one or more annunciation devices. Alternatively, the method may be programmed to wait for a plurality of alarm notification signals to be sent from the control unit before triggering the one or more annunciation devices.

DESCRIPTION OF EMBODIMENTS

Figure 1:
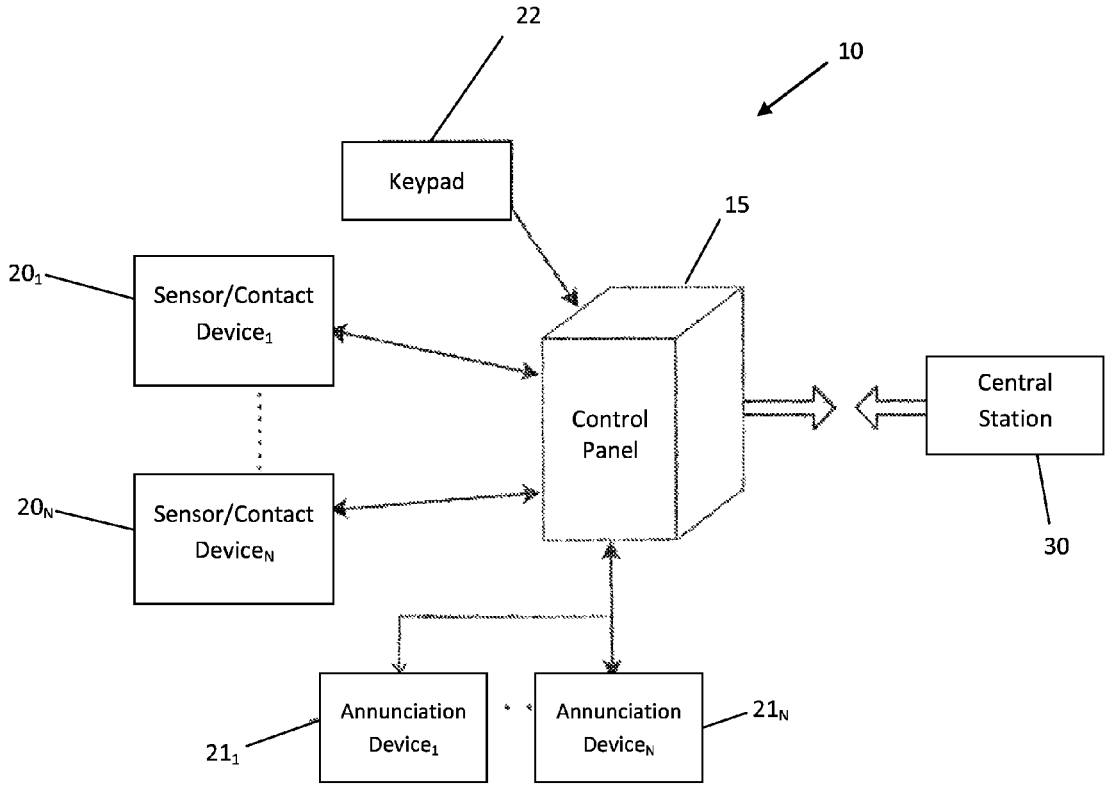
FIG. 1 illustrates a block diagram of an exemplary security system in accordance with the present invention.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1 is a block diagram of an exemplary security system 10 including a control panel 15, a plurality of sensor/contact devices $\mathbf{20}_1$-$\mathbf{20}_N$, annunciation devices $\mathbf{21}_1$-$\mathbf{21}_N$, for and at least one user interface 22 (e.g. keypad). A non-limiting exemplary list of such sensors/contact devices $\mathbf{20}_1$-$\mathbf{20}_N$ include heat, smoke, fire and toxic gas detectors, and door, window and motion detectors. Annunciation device(s) $\mathbf{21}_1$-$\mathbf{21}_N$, may be, for example, sirens, emergency lighting, strobe lighting, etc. Each of these devices communicates with the control panel 15 either through a hard wire connection or wireless interface to notify the control panel of one or more alarm or status conditions. One or more user interfaces 22 communicate with control panel 15 to arm, disarm, notify and generally control system 10. Control panel 15 communicates with each of the devices $\mathbf{20}_1$-$\mathbf{20}_N$, $\mathbf{21}_1$-$\mathbf{21}_N$, 22 as well as communicating with a monitoring facility 30. Control panel 15 may include a communicator which sends and receives signals to/from the monitoring facility. For example, when an alarm condition occurs based on the operation of sensors $\mathbf{20}_1$-$\mathbf{20}_N$. This communication may be via a POTS, broadband connection (internet), GSM (Global System for Mobile communications) transmission, etc., to provide a communications link between the alarm system 10 and a central monitoring facility 30 that is geographically remote from the security system. When a person enters the premises where system 10 is installed, keypad 22 provides warning beeps to notify the entering person to disarm system 10. The sensor activated by the entry of a person, for example sensor $\mathbf{20}_1$, sends a signal to control panel 15. In previous systems, a user was provided a predetermined time period (e.g. 60 seconds) to disarm the system before a notification signal from control panel 15 was sent to the central monitoring station 30. In addition, a signal was sent from the control panel 15 to siren 21 to sound an alarm if the system was not disarmed. If an intruder entered the premises, the sound of the siren allows the intruder to locate the siren and disable or destroy it. In contrast in the present system, once a sensor is triggered and system 10 communicates with central station 30, a signal is sent to trigger siren 21 after the transmission of the alarm notification was successfully communicated to central station 30. Thus, the delay time at the end of which siren 21 is triggered is dynamic based on the length of time needed to perform a successful alarm notification transmission between system 10 and central station 30. Once this signal is successfully transmitted to the central station 30, the siren 21 is triggered. In this manner, if communication between the control panel and central station requires multiple communication attempts, an intruder is not alerted to the location of the siren or the control panel if a siren is incorporated therein. Optionally, if repeated attempts to communicate between the control panel and the central station are unsuccessful after the predetermined time period, the control panel sends a signal to trigger the one or more annunciation devices $\mathbf{21}_1$-$\mathbf{21}_N$.

Figure 2:
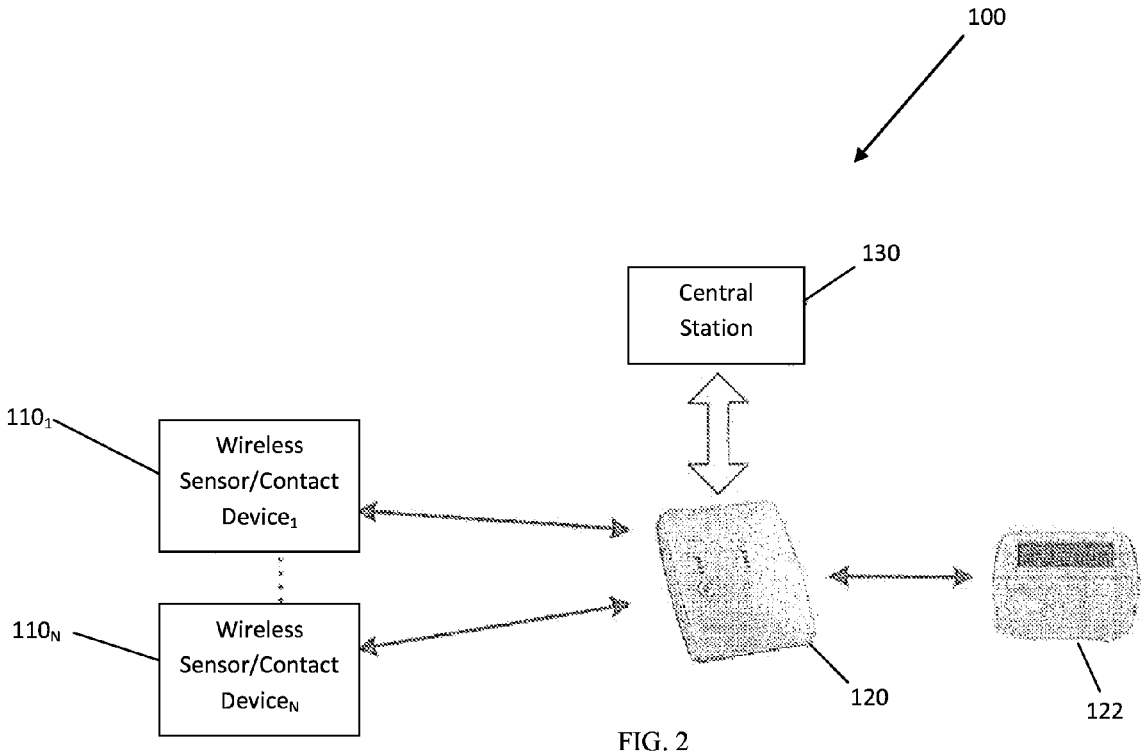
FIG. 2 illustrates a block diagram of an exemplary security system in accordance with the present invention.

FIG. 2 illustrates a block diagram of an exemplary security system 100 for a commercial or residential building which includes a plurality of wireless sensor/contact devices $\mathbf{110}_1$-$\mathbf{110}_N$ positioned throughout the building or a portion of the building, and a main unit 120 configured to receive signals from each of the foregoing devices $\mathbf{110}_1$-$\mathbf{110}_N$. A non-limiting exemplary list of such devices $\mathbf{110}_1$-$\mathbf{110}_N$ include heat, smoke, fire and toxic gas detectors, and door, window and motion detectors as well as various annunciation device(s) including, for example, sirens, emergency lighting, strobe lighting, etc. The wireless devices $\mathbf{110}_1$-$\mathbf{110}_N$, are capable of sending wireless signals to main unit 120 indicative of one or more alarm or status conditions. Communications between the devices and the main unit 120 may be via one or more wireless (e.g., RF, Infrared, laser) communications links. The wireless devices $\mathbf{110}_1$-$\mathbf{110}_N$ may be battery powered, and may be configured to transmit a signal representative of the status of the devices (e.g., alarm condition or other status). The devices may also be configured to transmit an identification signal that enables the main unit 120 to recognize the particular device, or the type of device (e.g., door contact, motion detector). User interface or keypad 122 communicates with main unit 120 to provide arming, disarming and control instructions for system 100. Main unit 120 may also include a keypad to provide an additional user interface for system 100.

The main unit 120 is configured as a communicator with monitoring facility 130 located remotely from system 100. Similar to system 10, main unit 120 communicates with monitoring facility 130 via POTS, broadband connection, GMS, etc. To reduce costs, main unit 120 may also include a built-in annunciation device (e.g., siren) to provide a warning to an occupant when an intruder triggers one or more alarm conditions. For example, when devices $\mathbf{110}_1$-$\mathbf{110}_N$ includes one or more sensors/detectors and a person enters the premises, the sensors/electors trigger an alarm notification signal which is sent to monitoring facility 130 by main unit 120. Once this signal is successfully transmitted to the monitoring facility 130, the siren housed within main unit 120 is sounded. In addition, other sounders such as, for example, sounders located in the keypad and/or other notification devices may also sound immediately upon triggering of one or more of the sensors/detectors. Thus, the delay time to trigger an annunciation device is dynamic based on the time it takes for successful transmission of an alarm notification to the monitoring facility 130. In the event that transmission to monitoring facility 130 takes longer based on GSM malfunction, internet traffic, etc., the annunciation device in unit 120 is not triggered thereby preventing an intruder from locating unit 120 until after communication with the central station 130. If a secondary annunciation device located in the keypad 122 or as one of the wireless devices $\mathbf{110}_1$-$\mathbf{110}_N$ sounds immediately upon triggering of one or more alarm conditions as referenced above, an intruder would still not locate the unit 120 since the siren in the unit is delayed until successful transmission with monitoring facility 130. By dynamically delaying the sounding of an annunciation device, an intruder is not aware of the location of the siren and because the notification signal was successfully transmitted to the monitoring facility 130 before the annunciation device is triggered, the intruder does not know that the alarm notification has been sent to central station 130. In addition, by delaying the sounding of the siren until successful notification transmission from unit 120 to monitoring facility 130, an intruder does not know where the main unit (i.e. unit 120) is located, thereby preventing destruction of the main unit which incorporates the sounder and the communicator until after the communication with monitoring facility 130.

Figure 3:
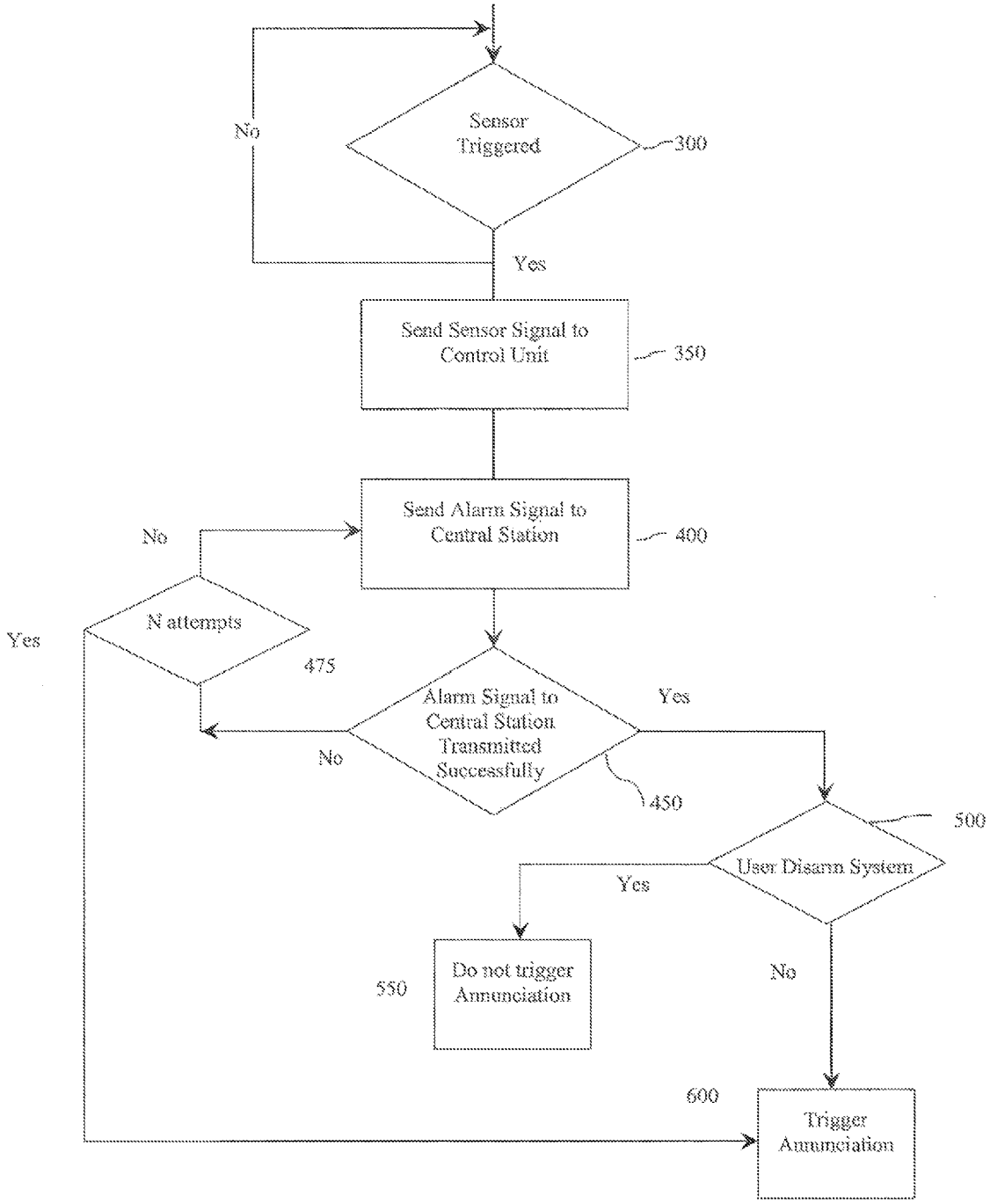
FIG. 3 is a flow chart illustrating a method of dynamically delaying an annunciation trigger in accordance with the present invention.

FIG. 3 is a flow chart illustrating a method of dynamically delaying an annunciation trigger based on the successful communication between a security system and a remote monitoring facility. The annunciation delay may be run by a processor housed in a main control unit which provides instruction signals to a communicator that communicates with a monitoring facility or to an intermediary clearing house location. A determination is made at step 300 whether or not one or more of a plurality of sensors are triggered indicating the presence of an alarm condition. If no sensor is triggered, the method returns to the beginning and waits. If a sensor is triggered, the sensor sends a signal to the control unit at step 350 and the control unit sends an alarm notification signal via a communicator to the monitoring facility at step 400 via POTS, internet or GSM communication link. A determination is made whether or not the alarm signal was communicated to the central station successfully at step 450. This determination is based on the receipt of an acknowledgement signal received by the communicator in the control unit from the monitoring facility. If the alarm signal was not transmitted successfully within a given time period such as, for example, a few seconds, the method returns to step 400 and repeats until transmission is completed. If the alarm signal is not transmitted successfully repeatedly based on a number of attempts (N) as determined at step 475, the annunciation device is triggered at step 600 by the control unit. If the alarm signal was transmitted successfully and the user did not disarm the system as determined at step 500, then an annunciation device, such as a siren, strobe lights, etc. is triggered at step 600. If a user disarmed the system, then the annunciation device is not triggered at step 550. If the one or more sensors that are triggered include an entry zone of the system, the transmission of the alarm notification signal to the monitoring facility may be delayed (e.g. thirty (30) seconds) allowing a user to disarm the system. During this delay period, the annunciation device is not triggered thereby providing no indication to the intruder of the location of the control unit and/or communicator. In this manner, the control unit delays the triggering of an annunciation device until successful transmission of an alarm notification to the monitoring facility. The time period after a sensor is triggered and the triggering of the annunciation device is not predetermined, but rather is dynamic based on the successful transmission of an alarm notification signal to the central station.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A system for transmitting alarm notifications for use with a system in a monitored building comprising a plurality of sensors, an annunciation device and a main control unit, said main control unit communicating with each of the plurality of sensors, the annunciation device, and a central monitoring facility, the system for transmitting alarm notifications configured to perform a method comprising:

receiving event signal data from at least one of the plurality of sensors;

processing the event signal data at the main control unit;

sending an alarm notification signal representative of the event signal from the main control unit to a receiver at the central monitoring facility;

determining whether the alarm notification signal was transmitted successfully to the receiver at the central monitoring facility, said determining comprising receiving, at the main control unit, an acknowledgement signal from the central monitoring station that the notification signal was received by the receiver; and upon receiving the acknowledgement signal from the central monitoring facility, sending a signal from the main control unit to the annunciation device to trigger said annunciation device.

2. The system of claim 1, wherein the event signal data is representative of an alarm condition sensed by at least one of said plurality of sensors located within the monitored building.

3. The system of claim 1, wherein the event signal data is representative of a status of an alarm system associated with the monitored building.

4. The system of claim 1, wherein the main control unit and the central monitoring facility are connected via a communications link selected from the list consisting of an analog telephone line, a digital telephone line, and a wireless connection.

5. The system of claim 1 wherein the processor further comprises the step of determining whether or not a user has disarmed the system prior to the main control unit sending a signal to the annunciation device to trigger the annunciation device.

6. The system of claim 1 wherein the main control unit includes a communicator configured to transmit and receive signals between the central monitoring facility and said main control unit.

7. The system of claim 1 wherein the annunciation device is a siren sounder.

8. The system of claim 1 wherein the annunciation device is a strobe light.

9. The system of claim 1 wherein the method further comprises, if the alarm notification signal is not successfully transmitted to the central monitoring facility, resending the alarm notification signal representative of the event signal from the main control unit to the receiver at the central monitoring facility.

10. The system of claim 1 wherein the plurality of sensors communicate with the main control unit via a wireless communication link.

11. The system of claim 7 wherein the siren sounder communicates with the main control unit via a wireless communication link.

12. The system of claim 1 wherein the main control unit further comprises a user interface configured to control operation of the system.

13. The system of claim 1, wherein a delay time is defined as a time between receiving event signal data from at least one of the plurality of sensors and receiving the acknowledgement signal from central monitoring facility, and wherein the delay time is dynamic based on the time it takes for successful transmission of an alarm notification to the central monitoring station.

14. A method of providing a dynamic annunciation signal in an alarm system comprising:

triggering at least one of a plurality of sensors;

sending event signal data from the least one of the plurality of sensors to a control unit;

sending an alarm notification signal from the control unit to a monitoring facility via a communications link;

waiting for the alarm notification signal from the control unit to be successfully transmitted to the monitoring facility, said waiting comprising receiving, at the control unit, an acknowledgement signal from the monitoring facility that the notification signal was received by the monitoring facility; and once the acknowledgement signal is received from the monitoring facility, sending a signal to an annunciation device communicating with the control unit to trigger the annunciation device.

15. The method of claim 14 further comprising, if the alarm notification signal is not successfully transmitted to the monitoring facility, resending the alarm notification signal from the control unit to the monitoring facility via the communication link.

16. The method of claim 14 wherein sending the alarm notification signal from the control unit to the monitoring facility is via a communications link wherein the communications link is selected from the list consisting of an analog telephone line, a digital telephone line, and a wireless connection.

17. The method of claim 14 wherein event signal data is sent from each of the plurality of sensors to the control unit via a wireless communications link.

18. The method of claim 14 wherein said annunciation device is a main annunciation device associated with said control unit, said method further comprising triggering a secondary annunciation device to sound upon the triggering of one or more of said sensors until a user disarms the alarm system.

19. The method of claim 14, wherein a delay time is defined as a time between sending event signal data from the least one of the plurality of sensors to a control unit and receiving the acknowledgement signal from the monitoring facility that the notification signal was received by the monitoring facility, and wherein the delay time is dynamic based on the time it takes for successful transmission of an alarm notification to the monitoring facility.

* * * * *